US010557677B1

(12) United States Patent
Martelli

(10) Patent No.: US 10,557,677 B1
(45) Date of Patent: Feb. 11, 2020

(54) MAGAZINE LOADER APPARATUS AND METHOD

(71) Applicant: John D. Martelli, Pensacola, FL (US)

(72) Inventor: John D. Martelli, Pensacola, FL (US)

( * ) Notice: Subject to any disclaimer, the term of this patent is extended or adjusted under 35 U.S.C. 154(b) by 0 days.

(21) Appl. No.: 15/933,641

(22) Filed: Mar. 23, 2018

Related U.S. Application Data

(60) Provisional application No. 62/475,922, filed on Mar. 24, 2017.

(51) Int. Cl.
*F41A 9/83* (2006.01)
*F41A 9/67* (2006.01)

(52) U.S. Cl.
CPC . *F41A 9/83* (2013.01); *F41A 9/67* (2013.01)

(58) Field of Classification Search
CPC ..... F41A 9/83; F41A 9/85; F41A 9/82
See application file for complete search history.

(56) References Cited

U.S. PATENT DOCUMENTS

| | | | | |
|---|---|---|---|---|
| 9,354,008 | B1 * | 5/2016 | Cifers | F41A 9/83 |
| 9,719,741 | B1 * | 8/2017 | Cifers | F41A 9/83 |
| 2010/0175294 | A1 * | 7/2010 | Meinel | F41A 9/83 42/87 |
| 2017/0051992 | A1 * | 2/2017 | Cottrell | F41A 9/83 |
| 2017/0176121 | A1 * | 6/2017 | Plate | F41A 9/83 |

FOREIGN PATENT DOCUMENTS

WO WO-2015171081 A1 * 11/2015 ..... F41A 9/83

* cited by examiner

*Primary Examiner* — Benjamin P Lee
(74) *Attorney, Agent, or Firm* — J. Nevin Shaffer, Jr.

(57) ABSTRACT

A magazine loader apparatus and method includes in one embodiment, a magazine holder where the magazine holder is configured to removably hold a magazine and where the magazine holder includes a loading chamber configured to receive a bullet. A loading arm connected with the magazine holder, a plunger connected with the loading arm, and a bullet loader where the bullet loader is configured to temporarily hold the bullet and where the bullet loader is removably connectable with the magazine holder at the loading chamber such that the bullet exits the bullet loader into the loading chamber.

19 Claims, 10 Drawing Sheets

MAGAZINE LOADER APPARATUS AND METHOD

CROSS REFERENCE TO RELATED APPLICATION

This application claims the benefit of previously filed U.S. provisional patent application No. 62/475,922 filed Mar. 24, 2017 for a "Magazine Loader Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a magazine loader apparatus and method. In one embodiment, a magazine loader apparatus includes a magazine holder where the magazine holder is configured to removably hold a magazine and where the magazine holder includes a loading chamber configured to receive a bullet. A loading arm is connected with the magazine holder and a plunger is connected with the loading arm. A bullet loader is provided where the bullet loader is configured to temporarily hold the bullet and the bullet loader is removably connectable with the magazine holder at the loading chamber such that a bullet exits the bullet loader into the loading chamber.

BACKGROUND OF THE INVENTION

It is a difficult task to load a gun magazine. The action is repetitive and tiring. In just a short while thumbs are sore and wrists are fatigued. The chore does not get easier as the loader ages. Pistol magazines are more difficult than others but all suffer from the same issues particularly when the magazine is being filled to capacity.

Thus, there is a need in the art for a device that simplifies the loading of a gun magazine, that eliminates sore thumbs and wrists and allows even the most difficult magazine to be fully loaded.

It therefore is an object of this invention to provide an improved magazine loader that is easy to use, eliminates common fatigue issues and allows a user to fill any magazine, including pistol magazines, to capacity quickly and efficiently.

SUMMARY

Accordingly, a magazine loader apparatus, according to a preferred embodiment, includes a magazine holder where the magazine holder is configured to removably hold a magazine and where the magazine holder includes a loading chamber configured to receive a bullet. A loading arm is connected with the magazine holder and a plunger is connected with the loading arm. A bullet loader is provided where the bullet loader is configured to temporarily hold the bullet and where the bullet loader is removably connectable with the magazine holder at the loading chamber such that a bullet exits the bullet loader into the loading chamber.

In another aspect, the apparatus further includes a bullet ram configured to fit within the loading chamber and to contact the bullet in the loading chamber and to move the bullet to position above a magazine in the magazine holder.

In one aspect, the apparatus further includes a bullet feed platform removably connectable with the bullet loader where the bullet feed platform is configured to support the bullet as the bullet is inserted into the bullet loader.

In one aspect, the bullet loader includes a top and a bottom and spaced apart angled sides where the spaced apart angled sides are wider at the top and narrower at the bottom.

In a further aspect, the bullet loader is gravity fed.

In another aspect, the bullet loader is configured to hold more than one bullet.

In one aspect, the magazine holder includes a recess configured to removably hold a magazine where the recess aligns with the loading chamber such that a bullet from the loading chamber is positioned above a magazine held in the recess.

In a further aspect, the magazine loader includes an enlarged bullet receiving receptacle.

In another aspect, the plunger includes a foot where the foot is configured to contact a bullet and, in another aspect, the plunger includes an elongated "L" shaped foot.

In one aspect, the magazine is a pistol magazine.

According to another embodiment, a magazine loader apparatus consists of a magazine holder where the magazine holder includes a loading chamber configured to receive a bullet. A loading arm is connected with the magazine holder and a plunger is connected with the loading arm. A bullet loader is provided where the bullet loader is configured to temporarily hold the bullet and where the bullet loader is removably connectable with the magazine holder at the loading chamber such that a bullet exits the bullet loader into the loading chamber. A bullet ram is provided that is configured to fit within the loading chamber and to contact a bullet in the loading chamber and to move the bullet into position above a magazine in the magazine holder. And a recess is provided in the magazine holder that is configured to removably hold a magazine where the recess aligns with the loading chamber such that a bullet from the loading chamber is positioned above a magazine held in the recess.

In one aspect, the device further includes a bullet feed platform removably connectable with the bullet loader where the bullet feed platform is configured to support the bullet as a bullet is inserted into the bullet loader.

In another aspect, the bullet loader includes a top and a bottom and spaced apart angled sides where the spaced apart angled sides are wider at the top and narrower at the bottom.

In one aspect, the bullet loader is configured to hold more than one bullet.

In a further aspect, the magazine loader includes an enlarged bullet receiving receptacle directly above the magazine recess.

In another aspect, the plunger includes a foot where the foot is configured to contact a bullet and, in another aspect, the plunger includes an elongated "L" shaped foot.

According to another embodiment, a magazine loading method consists of:

a. providing a magazine holder where the magazine holder is configured to removably hold a magazine and where the magazine holder includes a loading chamber configured to receive a bullet; a loading arm connected with the magazine holder; a plunger connected with the loading arm; and a bullet loader where the bullet loader is configured to temporarily hold the bullet and where the bullet loader is removably connectable with the magazine holder at the loading chamber such that the bullet exits the bullet loader into the loading chamber; and b. connecting the bullet loader with the magazine holder.

In one aspect, the method further includes a bullet ram configured to fit within the loading chamber and to contact the bullet in the loading chamber and to move the bullet to position above a magazine in the magazine holder.

In another aspect, the method further includes the steps of:

a. placing a magazine in said magazine holder;

b. loading a bullet in the bullet holder such that the bullet exits the bullet holder and enters the loading chamber;

c. operating the bullet ram to position a bullet above a magazine connected with the magazine holder; and d. operating the loading arm to move the plunger to press the bullet into the magazine.

In a further aspect, the magazine loader includes an enlarged bullet receiving receptacle directly above a magazine recess configured to hold a magazine.

DESCRIPTION OF THE DRAWINGS

Other objects, features and advantages of the present invention will become more fully apparent from the following detailed description of the preferred embodiment, the appended claims and the accompanying drawing in which:

DETAILED DESCRIPTION OF EMBODIMENTS

Figure 1:
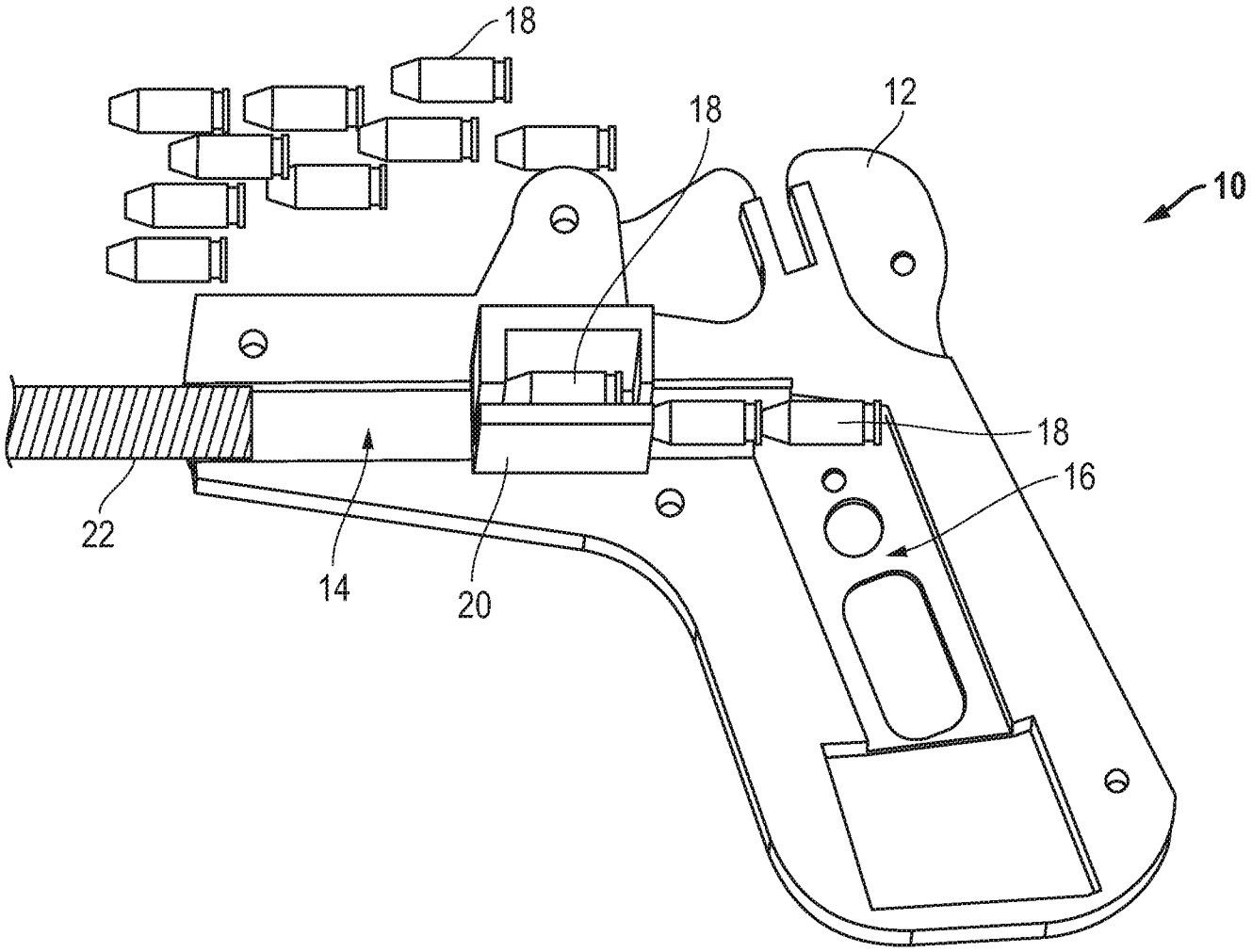
FIG. 1 is a partial perspective cut away view of the magazine loader apparatus of the present invention according to one embodiment.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described method may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-10. With specific reference to FIG. 1, magazine loader apparatus 10 includes magazine holder 12. Magazine holder 12 includes a loading chamber 14 and, preferably, a recess 16, where the loading chamber 14 is configured to receive a bullet 18 and the recess 16 is configured to hold a magazine 28 (not shown for purposes of clarity in FIG. 1, see FIG. 2).

Bullet loader 20 holds bullet(s) 18 and is connected temporarily with magazine loader 10 at the loading chamber 14 as shown. Bullet(s) 18 exit bullet loader 20 and enter loading chamber 14. At that point, preferably, bullet ram 22, configured to movably fit in loading chamber 14 is used to position bullet 18 above a magazine (not shown) held in recess 16.

Figure 2:
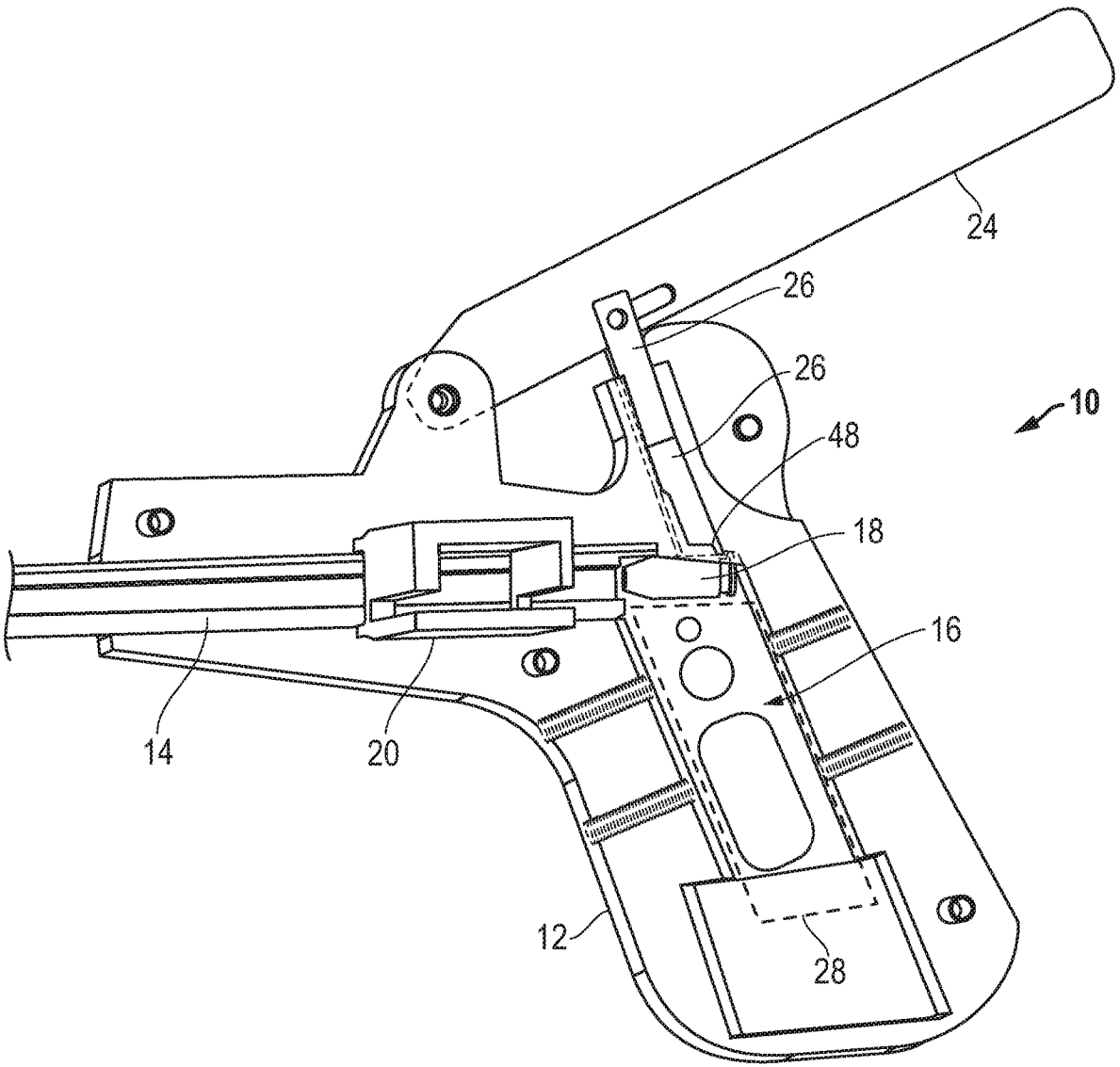
FIG. 2 is a perspective of the invention of FIG. 1 with the handle and plunger illustrated.
Figure 3:
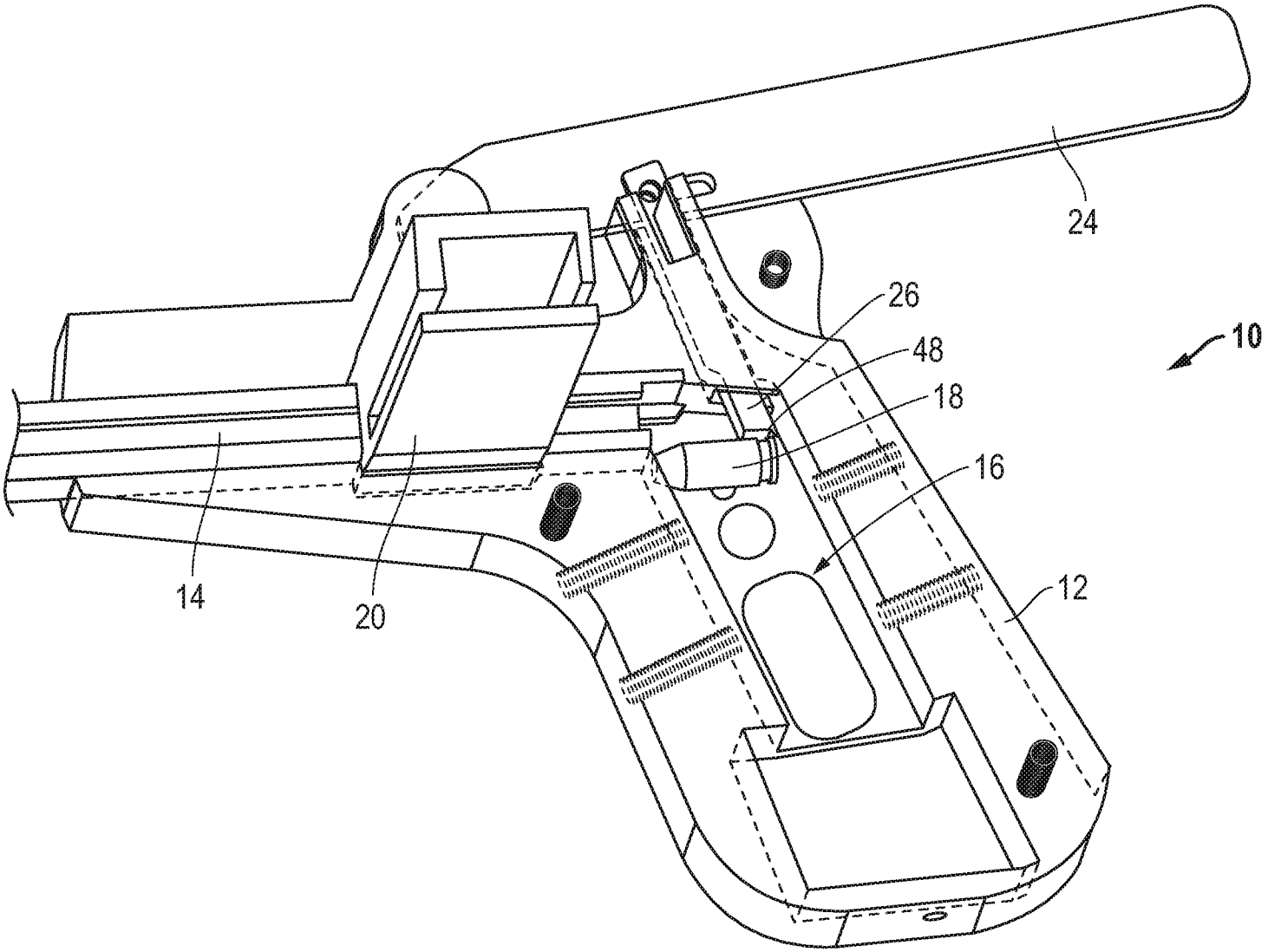
FIG. 3 is a perspective view of the invention of FIG. 2 showing the plunger contacting a bullet.

Referring now to FIG. 2, loading arm 24 is shown connected with magazine holder 12. Plunger 26 is connected with loading arm 24 such that, as illustrated in the Figures, operation of loading arm 24 moves plunger 26 from the position shown in FIG. 2 to the position of contact with a bullet 18 shown in FIG. 3. Contact is made in this embodiment, by the "foot" 48 of plunger 26. Foot 48 as shown in FIG. 3 is relatively short and contacts only a small part of bullet 18 as compared to another aspect of the invention including a larger "L" shaped foot as illustrated and described more fully hereafter in reference to FIGS. 8-10.

In this aspect, continued operation of loading arm 24 presses the bullet 18 into the magazine 28 thus providing a space in the magazine 28 for bullet ram 22 to push bullet 18 into magazine 28 (shown in outline in recess 16 in FIG. 2). Thereafter, loading arm 24 is lifted, causing the plunger 26 to clear the top of the magazine 28. Then, bullet ram 22 is used to position another bullet 18 over the top of magazine 28 and the process is repeated.

Figure 4:
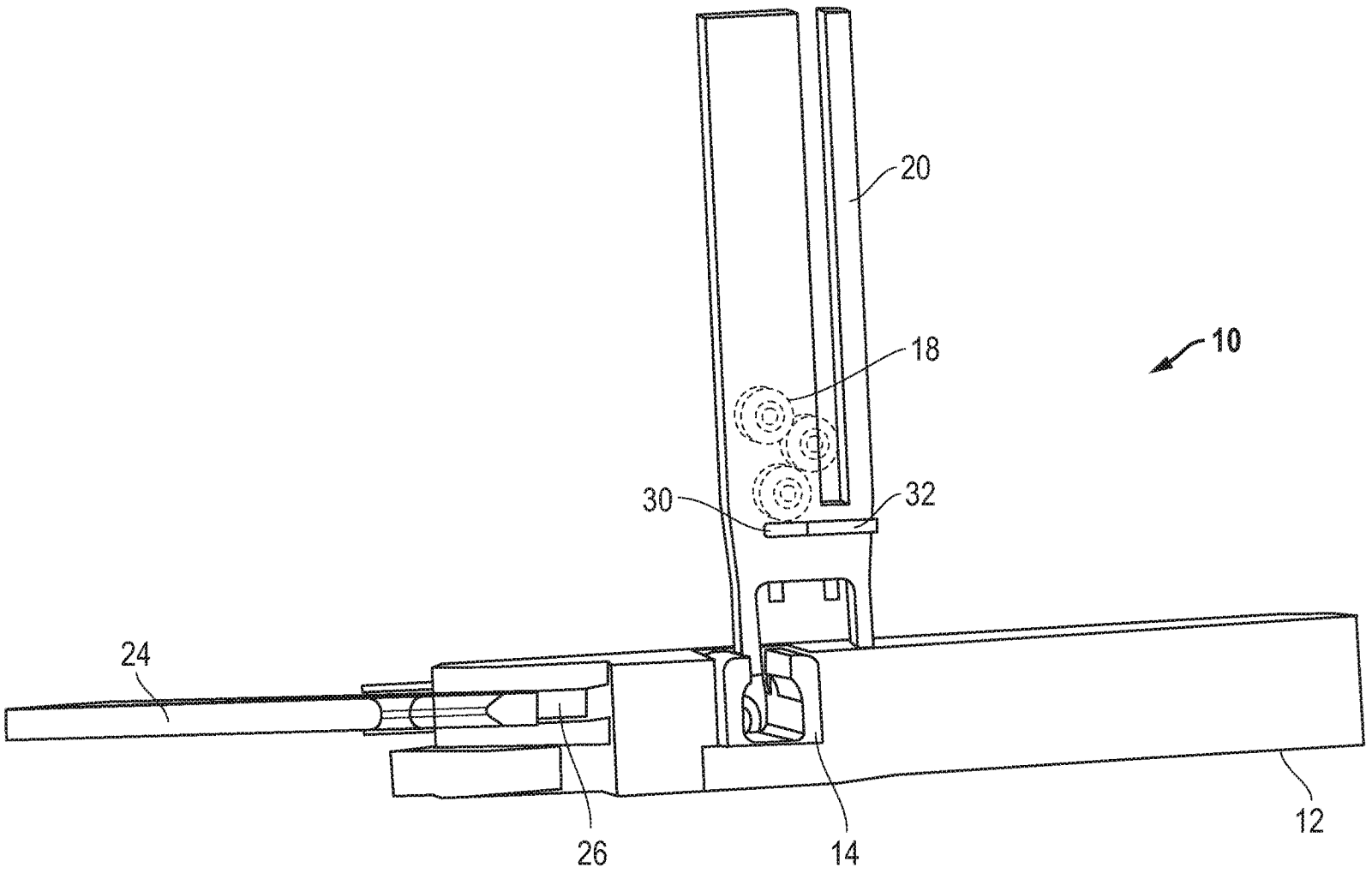
FIG. 4 is a side view of the invention of FIG. 1 showing the bullet loader and bullet feed platform supporting bullets in the bullet loader.
Figure 5:
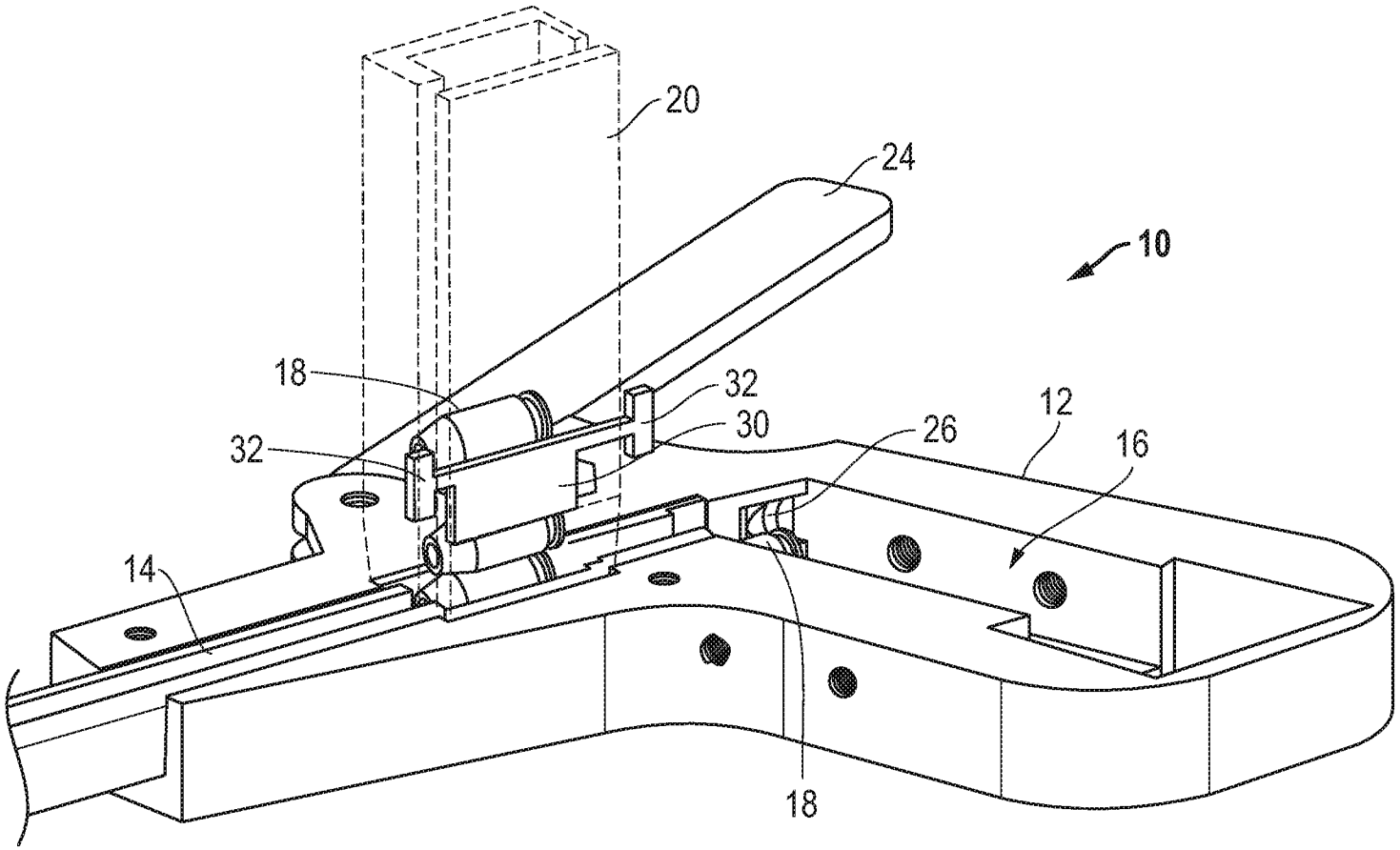
FIG. 5 is a side view of the invention of FIG. 4 showing the bullet feed platform rotated to release bullets into the bullet loader.
Figure 6:
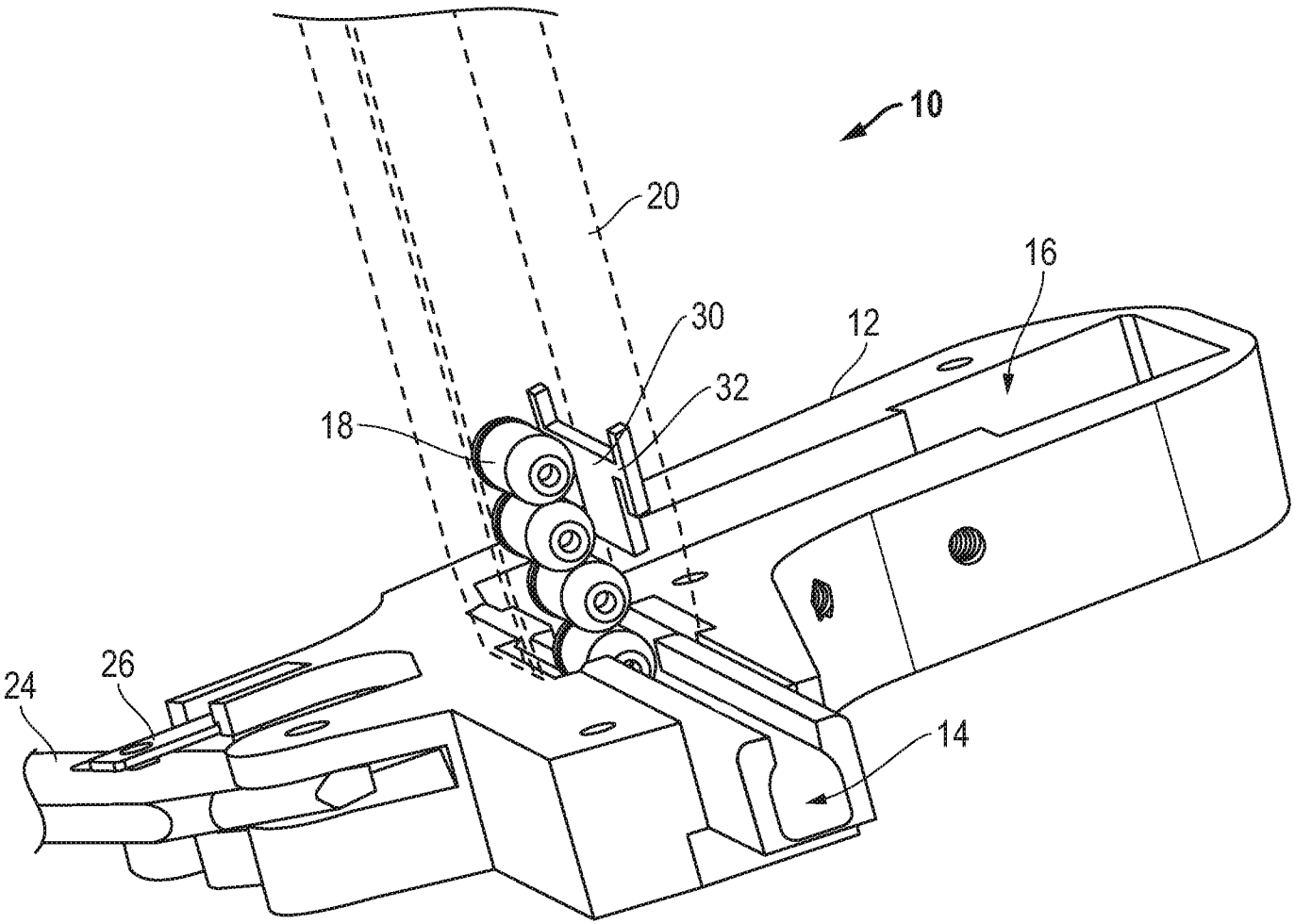
FIG. 6 is a side view of FIG. 5.

FIGS. 4-6 illustrate another element of the invention, bullet feed platform 30. In FIG. 4, bullet feed platform 30 is shown supporting three bullets 18 within bullet loader 20. Bullet feed platform 30 precisely holds bullets 18 within bullet loader 20 so that the bullets 18 do not tumble and miss-align themselves while being placed within bullet loader 20.

FIGS. 5 and 6 show that bullet feed platform 30 includes exterior handles 32 used to manipulate bullet feed platform 30 to lower the bullets 18 into bullet loader 20 and then to rotate bullet feed platform 30 out of the way after depositing bullets 18. When bullet loader 20 is empty, more bullets 18 are placed onto bullet feed platform 30 and the process is repeated. In one instance, bullet loader 20 gravity feeds bullets 18 into loading chamber 14. Certainly, automated feeding is also well within the scope of the invention as disclosed herein.

Figure 7:
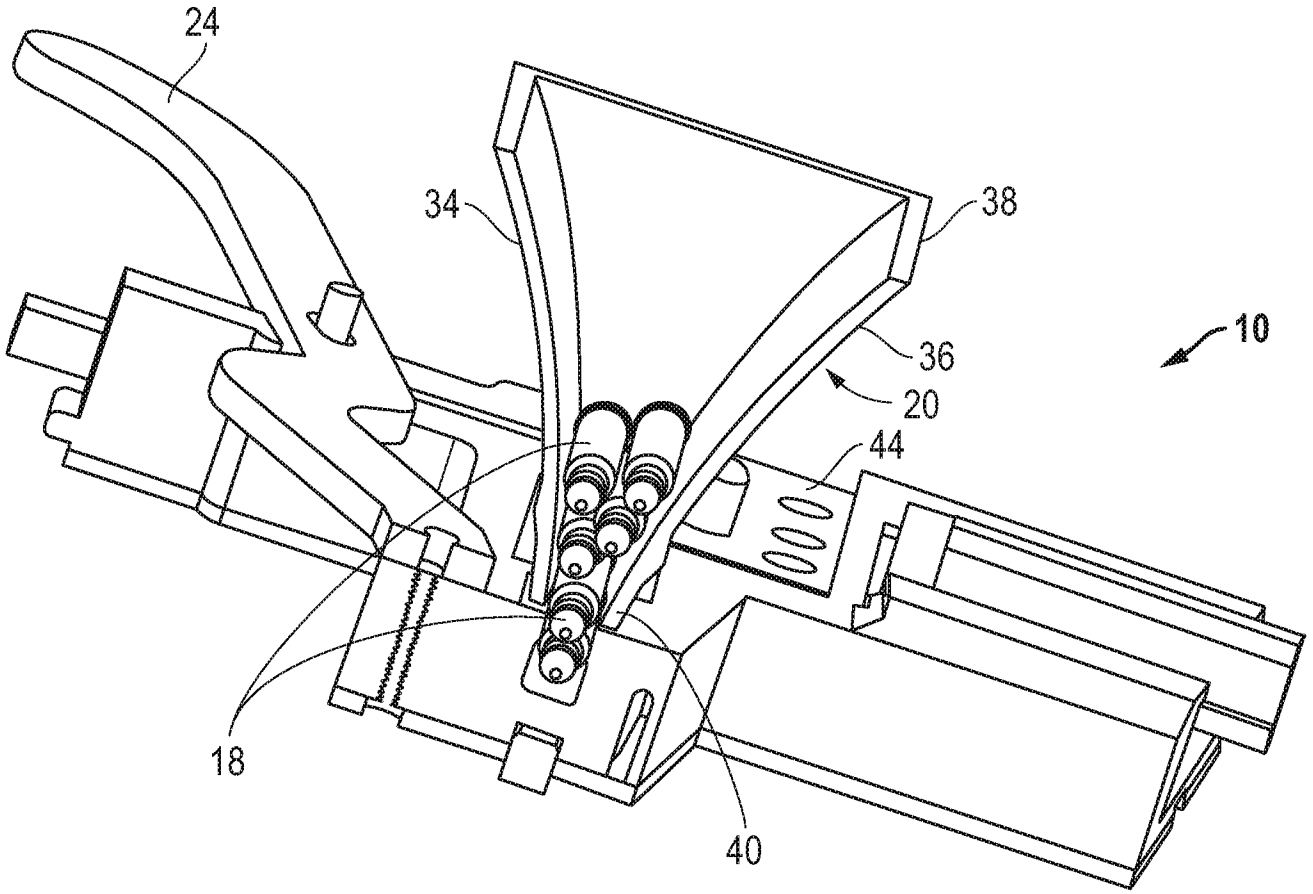
FIG. 7 a perspective view of the bullet loader with spaced apart angled sides where the spaced apart angled sides are wider at the top and narrower at the bottom.

Applicant has found that a bullet loader 20 as shown in FIG. 7, which include spaced apart angled sides 34 and 36 that are wide at the top 38 and that narrow to slightly more than the width of bullet 18 at the bottom 40 allows functioning of the bullet loader 20 without need of bullet feed platform 30 as just described.

Figure 8:
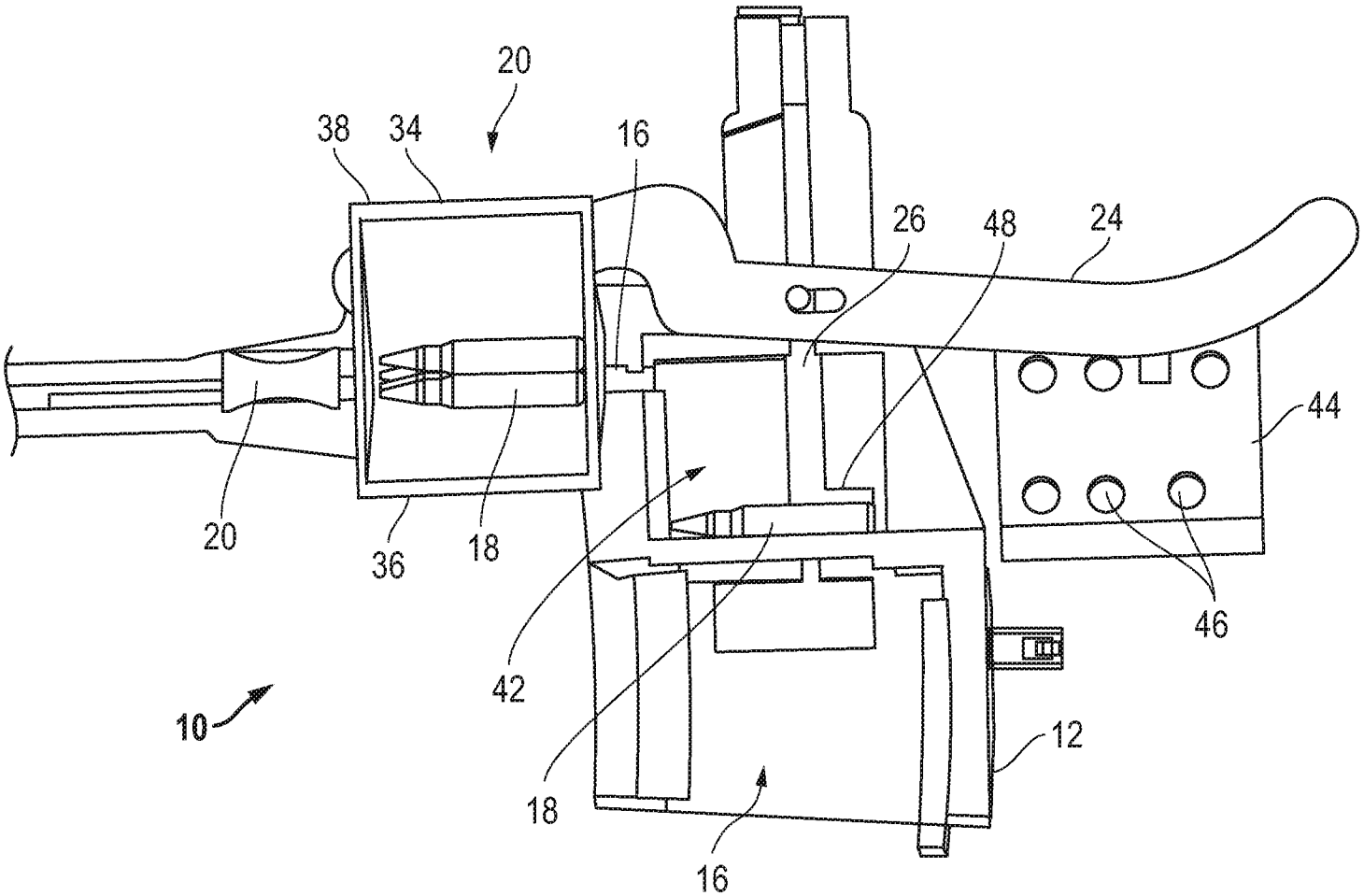
FIG. 8 is a side view of FIG. 7 illustrating the angled bullet loader and the partially filled enlarged bullet receiving receptacle.
Figure 9:
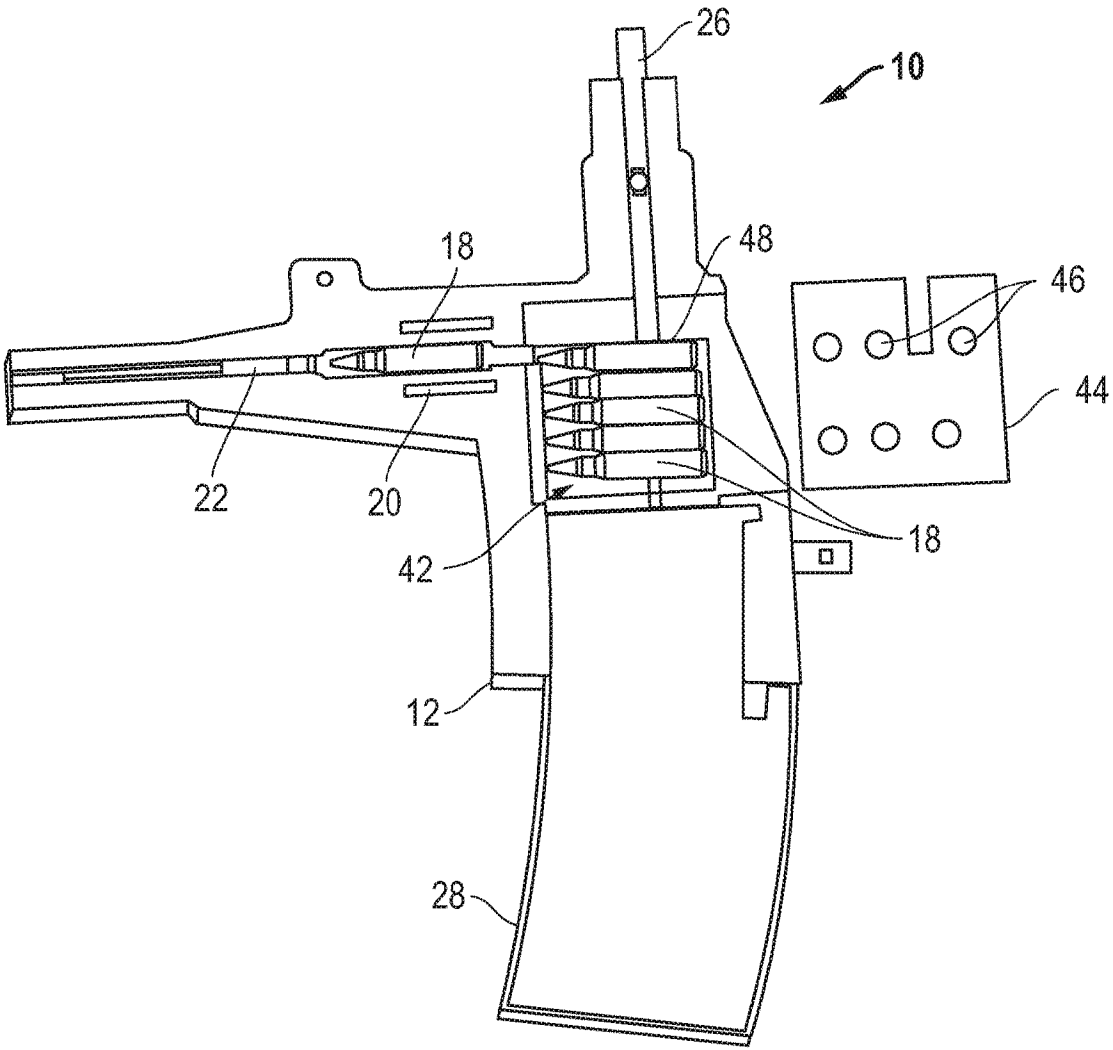
FIG. 9 is a side view of FIG. 8 illustrating the enlarged bullet receiving receptacle when full.
Figure 10:
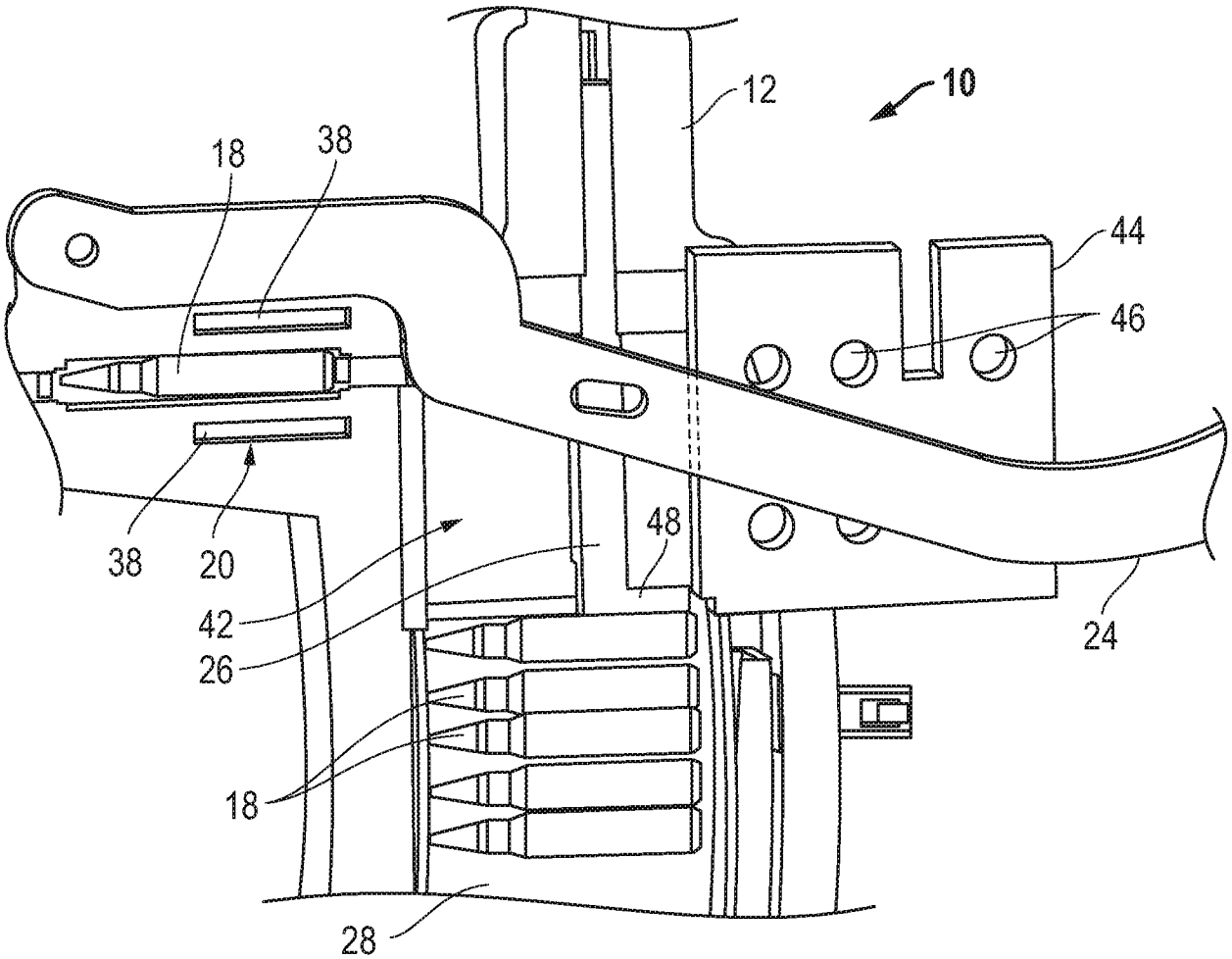
FIG. 10 is a close up view illustrating the use of the plunger with an "L" shaped foot loading a magazine with multiple bullets.

Referring now to FIGS. 8-10, FIG. 8 illustrates the use of the bullet loader 20 in conjunction with modified magazine loader 10. As shown, here magazine loader 10 includes enlarged bullet receiving receptacle 42. In this embodiment, the magazine loader 10 functions as described above but enlarged bullet receiving area 42 is configured to hold more than one bullet 18 at a time above magazine 28 (not shown in FIG. 8, see FIGS. 9 and 10). FIG. 8 shows multiple bullets 18 in bullet loader 20 with angled sides 34 and 36 and one bullet 18 having been pushed by bullet loader 20 into enlarged bullet receiving receptacle 42. Cover 44 is removably attached over enlarged bullet receiving receptacle 42 and is used to retain bullets 18 in, and to provide access to, enlarged bullet receiving receptacle 42. Openings 46 in cover 44 enable a user to determine loading status without having to remove cover 44.

Referring to FIG. 9, the process just described has been repeated such that enlarged bullet receiving receptacle 42 is full with five bullets 18, for example only and not by way of limitation, and all five bullets 18 are positioned directly above magazine 28.

Referring to FIG. 10, loading arm 24 has been operated such that plunger 26 has directly forced all five bullets 18 into magazine 28 with no need to use ram 22 to complete the loading as with the single bullet loading described with reference to FIGS. 1-6. FIG. 10 shows that Applicant has found that a plunger 26 with a longer "L" shaped "foot"48 helps with this process. That is, the foot 48 of plunger 26 shown in FIGS. 1-6 is shorter than the foot 48 shown in FIGS. 8-10. The larger "L" shaped foot 48 covers more surface of bullet 18 and facilitates the loading of multiple bullets 18 into magazine 28.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A magazine loader apparatus comprising:

a. a magazine holder wherein said magazine holder is configured to removably hold a magazine and wherein said magazine holder includes a loading chamber configured to receive more than one bullet, wherein bullet includes a front, a middle and a back;

b. a loading arm connected with said magazine holder;

c. a plunger connected with said loading arm wherein said plunger includes a foot and wherein said foot is configured to contact a bullet at the approximate middle of the bullet;

d. a bullet loader wherein said bullet loader is configured to temporarily hold a bullet and wherein said bullet loader is removably connectable with said magazine holder at said loading chamber such that said bullet exits said bullet loader into said loading chamber; and e. a bullet feed platform removably connectable with said bullet loader wherein said bullet loader includes a top and a bottom and wherein said bullet feed platform is movable within said bullet loader from said top of said bullet loader to said bottom of said bullet loader wherein said bullet feed platform is configured to support said bullet as a bullet is inserted into said bullet loader at said top and to support said bullet to said bottom of said bullet loader.

2. The apparatus of claim 1 further including a bullet ram configured to fit within said loading chamber and to contact a bullet said loading chamber and to move said bullet into position above a magazine in said magazine holder.

3. The apparatus of claim 1 wherein said bullet loader includes a top and a bottom and spaced apart angled sides wherein said spaced apart angled sides both angle away from vertical at the top and angle away from each other at the top such that the angled sides are wider apart at the top and closer together at the bottom.

4. The apparatus of claim 1 wherein said bullet loader is configured to hold more than one bullet.

5. The apparatus of claim 1 wherein said magazine holder includes a recess configured to removably hold a magazine wherein said recess aligns with said loading chamber such that a bullet from said loading chamber is positioned above a magazine held in said recess.

6. The apparatus of claim 5 wherein said magazine loader includes an enlarged bullet receiving receptacle for holding more than one bullet directly above said magazine recess.

7. The apparatus of claim 1 wherein said plunger includes a "L" shaped foot wherein the "L" shaped foot is configured to contact a bullet from the approximate middle of said bullet to the back of said bullet.

8. The apparatus of claim 1 wherein said loading chamber holds the more than one bullet in stacked relation, one on top of the other with a top bullet and a bottom bullet, and wherein said plunger foot contacts said top bullet at the approximate middle of the top bullet.

9. A magazine loader apparatus comprising:

a. a magazine holder wherein said magazine holder includes a loading chamber configured to receive a bullet connected with an enlarged bullet receiving area configured to receive more than one bullet and to hold bullets in stacked relation, one on top of the other, with a top bullet and a bottom bullet wherein said more than bullet includes a front, a middle and a back;

b. a loading arm connected with said magazine holder, c. a plunger connected with said loading arm wherein said plunger includes a transverse foot configured to contact said top bullet at the approximate middle of the top bullet;

d. a bullet loader wherein said bullet loader is configured to temporarily hold said bullet and wherein said bullet loader is removably connectable with said magazine holder at said loading chamber such that said bullet exits said bullet loader into said loading chamber;

e. a bullet ram configured to fit within said loading chamber and to contact said bullet in said loading chamber and to move said bullet into position in said enlarged bullet receiving area above a magazine in said magazine holder;

f. a recess configured to removably hold a magazine wherein said recess aligns with said loading chamber such that a bullet from said loading chamber is positioned in said enlarged bullet receiving area directly above a magazine held in said recess; and g. a bullet feed platform removably connectable with said bullet loader wherein said bullet loader includes a top and a bottom and wherein said bullet feed platform is movable within said bullet loader from said top of said bullet loader to said bottom of said bullet loader wherein said bullet feed platform is configured to support said bullet as a bullet is inserted into said bullet loader at said top and to support said bullet to said bottom of said bullet loader.

10. The apparatus of claim 9 wherein said bullet loader includes a top and a bottom and spaced apart angled sides wherein said spaced apart angled sides both angle away from vertical at the top and angle away from each other at the top such that the angled sides are wider apart at the top and closer together at the bottom.

11. The apparatus of claim 9 wherein said bullet loader is configured to hold more than one bullet.

12. The apparatus of claim 9 wherein said transverse foot is configured to contact said top bullet from the approximate middle to the back of said top bullet.

13. The apparatus of claim 9 wherein said plunger includes a "L" shaped foot wherein the "L" shaped foot is configured to contact a bullet fro the approximate middle of said bullet to the back of said bullet.

14. A magazine loading method comprising:

a. providing a magazine holder wherein said magazine holder is configured to removably hold a magazine and wherein said magazine holder incudes a loading chamber configured to receive more than one ballet, wherein each bullet includes a front, a middle and a back; a loading arm connected with said magazine holder; a plunger connected with said loading arm wherein said plunger includes a foot and wherein said foot is configured to contact a bullet at the approximate middle of the bullet; a bullet loader wherein said bullet loader is configured to temporarily hold a bullet and wherein said bullet loader is removably connectable with said magazine holder at said loading chamber such that a bullet exits said bullet loader into said loading chamber;

a bullet feed platform removably connectable with said bullet loader wherein said bullet loader includes a top and a bottom and wherein said bullet feed platform is movable within said bullet loader from said top of said bullet loader to said bottom of said bullet loader wherein said bullet feed platform is configured to support said bullet as a bullet is inserted into said bullet loader at said ton and to support said bullet to said bottom of said bullet loader; and b. connecting said bullet loader with said magazine holder.

15. The method of claim 14 further including a bullet ram configured to fit within said loading chamber and to contact a bullet in said loading chamber and to move said bullet to position above a magazine in said magazine holder.

16. The method of claim 15 further including:

a. placing a magazine in said magazine holder;

b. loading a bullet in the bullet loader such that the bullet exits the bullet loader and the loading chamber;

c. operating the bullet ram position a bullet above a magazine connected with said magazine holder and repeating until more than one bullet is loaded into the loading chamber; and d. operating the loading arm to move the plunger to press the more than one bullet into the magazine.

17. The method of claim 14 wherein said plunger includes a "L" shaped foot wherein the "L" shaped foot contacts the bullet from the approximate middle of said bullet to the back of the bullet.

18. The method of claim 14 wherein said bullet loader includes a top and a bottom and spaced apart angled sides wherein said spaced apart angled sides both angle away from vertical at the top and angle away from each other at the top such that the angled sides are wider apart at the top and closer together at the bottom.

19. The method of claim 14 wherein said loading chamber holds more than one bullet in stacked relation, one on top of the other with a top bullet and a bottom bullet and wherein said plunger foot contacts said top bullet at the approximate middle of the top bullet.

* * * * *